US011674323B2

(12) United States Patent
Jiang et al.

(10) Patent No.: US 11,674,323 B2
(45) Date of Patent: Jun. 13, 2023

(54) DEVICE AND METHOD FOR REINFORCING ROUND SECTION WOOD BEAM BY COMBINATION OF PRESTRESSED FRP SHEET AND HIGH STRENGTH STEEL WIRE ROPE

(71) Applicant: Fuzhou University, Fuzhou (CN)

(72) Inventors: Shaofei Jiang, Fuzhou (CN); Jie Xu, Fuzhou (CN); Wenjin Yu, Fuzhou (CN); Ziyi Ge, Fuzhou (CN); Zehui Qiao, Fuzhou (CN); Chenyang Li, Fuzhou (CN)

(73) Assignee: FUZHOU UNIVERSITY, Fuzhou (CN)

( * ) Notice: Subject to any disclaimer, the term of this patent is extended or adjusted under 35 U.S.C. 154(b) by 0 days.

(21) Appl. No.: 17/457,149

(22) Filed: Dec. 1, 2021

(65) Prior Publication Data

US 2022/0178158 A1 Jun. 9, 2022

(30) Foreign Application Priority Data

Dec. 7, 2020 (CN) ..... 202011415724.4

(51) Int. Cl.
*E04G 23/02* (2006.01)

(52) U.S. Cl.
CPC ..... *E04G 23/0244* (2013.01); *E04G 23/0225* (2013.01); *E04G 2023/0248* (2013.01);
(Continued)

(58) Field of Classification Search
CPC ..... E04G 23/0244; E04G 23/0225; E04G 23/0218; E04G 2023/0248;
(Continued)

(56) References Cited

U.S. PATENT DOCUMENTS 846,001 A * 3/1907 Blessing ..... E04H 12/20 174/45 R
1,584,405 A * 5/1926 Spring ..... E04H 12/2292 52/170
(Continued)

FOREIGN PATENT DOCUMENTS

AU 2021273579 A1 * 6/2022
CN 103291082 A * 9/2013
(Continued)

*Primary Examiner* — Ryan D Kwiecinski
(74) *Attorney, Agent, or Firm* — Welsh Flaxman & Gitler LLC

(57) ABSTRACT

The present disclosure relates to a device and a method for reinforcing a round section wood beam by the combination of a prestressed Fiber Reinforce Plastic (FRP) sheet and a high strength steel wire rope. The device includes an FRP sheet adhered to a bottom surface of a log beam in the length direction. A middle supporting piece is mounted in the middle of the log beam. An end part reinforcing anchoring piece is mounted at each of two ends of the log beam. FRP hoops are adhered to the log beam and are located between the middle supporting piece and each of the end part reinforcing anchoring pieces at intervals in the length direction. High strength steel wire ropes with both ends connected to the corresponding end part reinforcing anchoring pieces are respectively arranged on the two sides of the middle supporting piece.

15 Claims, 4 Drawing Sheets

(52) U.S. Cl.
CPC ..... *E04G 2023/0259* (2013.01); *E04G 2023/0262* (2013.01)

(58) Field of Classification Search
CPC .... E04G 2023/0259; E04G 2023/0262; E04G 2023/0255; E04G 2023/0251; E04G 21/12; E04G 2021/127; E04G 2021/128; E04H 12/16; E04H 12/20; E04H 12/2292
See application file for complete search history.

(56) References Cited

U.S. PATENT DOCUMENTS 1,653,706 A * 12/1927 Holland ..... E04H 12/2292 249/173
2,593,714 A * 4/1952 Robinson ..... B29C 49/44 156/65
2,724,156 A * 11/1955 Shaw ..... E04H 12/2292 52/168
3,309,824 A * 3/1967 Barrett ..... E04G 23/0218 52/741.1
3,362,124 A * 1/1968 Val ..... E04G 23/0218 52/309.3
4,756,130 A * 7/1988 Burtelson ..... E04H 12/2292 52/170
4,800,690 A * 1/1989 Bunce ..... E04H 12/20 52/146
4,921,555 A * 5/1990 Skiff ..... B29C 73/025 156/215
5,383,749 A * 1/1995 Reisdorff ..... E02D 5/64 405/231
5,896,716 A * 4/1999 Jalla ..... E04G 23/0218 52/712
6,079,165 A * 6/2000 Bingel, III ..... E04H 12/2292 52/170
6,226,933 B1 * 5/2001 Nelson ..... E04H 12/20 43/124
6,389,766 B1 * 5/2002 Jackson ..... E04G 23/0218 52/801.12
7,987,638 B1 * 8/2011 Fang ..... E04G 23/0225 52/223.3
9,038,353 B2 * 5/2015 Huncovsky ..... E04G 23/0218 403/312
9,739,070 B2 * 8/2017 Bushore ..... E04C 3/30
10,870,999 B1 * 12/2020 Oliphant ..... E04G 23/0225
2003/0037496 A1 * 2/2003 Cappuccio ..... E04G 23/0218 52/291
2005/0210821 A1 * 9/2005 Bingel ..... E04G 23/0225 52/834
2007/0256388 A1 * 11/2007 Lanello ..... E04H 12/2292 52/651.07
2007/0261349 A1 * 11/2007 Goldman ..... E04H 12/2292 52/514
2015/0233132 A1 * 8/2015 Huncovsky ..... E04G 23/0218 52/514
2016/0060889 A1 * 3/2016 Tedesco ..... E04H 12/2238 52/514
2016/0060892 A1 * 3/2016 Odegard ..... E04H 12/2292 52/835
2018/0010355 A1 * 1/2018 Odegard ..... E04H 12/2292
2018/0142490 A1 * 5/2018 Eblen ..... E04H 12/12
2021/0025188 A1 * 1/2021 Rooney ..... E02F 3/8816
2022/0042311 A1 * 2/2022 Saadatmanesh ..... E04C 5/168
2022/0049509 A1 * 2/2022 Ehsani ..... E04G 23/0218
2022/0162867 A1 * 5/2022 Saadatmanesh .... E04H 12/2292
2022/0162874 A1 * 5/2022 Liu ..... E04H 12/20
2022/0178158 A1 * 6/2022 Jiang ..... E04G 23/0225

FOREIGN PATENT DOCUMENTS

CN 105484514 A * 4/2016 ..... E04G 23/0225
CN 105569368 A * 5/2016 ..... E04G 23/0225
CN 106760591 A * 5/2017
CN 107435456 A * 12/2017 ..... E04G 23/0225
CN 105525766 B * 1/2018
CN 107882354 A * 4/2018 ..... E04G 23/0218
CN 108678523 A * 10/2018
CN 110409859 A * 11/2019
CN 110894759 A * 3/2020 ..... E04H 12/00
CN 111042623 A * 4/2020
CN 112360179 A * 2/2021
CN 112392288 A * 2/2021 ..... E04G 21/12
CN 113216418 A * 8/2021
CN 113216685 A * 8/2021 ..... E04G 23/0218
CN 113279599 A * 8/2021 ..... E04G 23/0218
CN 113431367 A * 9/2021
CN 113738150 A * 12/2021
CN 113738151 A * 12/2021
CN 114000725 A * 2/2022
CN 114658258 A * 6/2022
CN 114673376 A * 6/2022
CN 114776528 A * 7/2022
CN 114908992 A * 8/2022
DE 19944573 A1 * 3/2001 ..... E04C 5/07
DE 102011107781 A1 * 1/2013 ..... E04H 12/2292
EP 1411185 A1 * 4/2004 ..... E04G 23/0218
EP 1705313 A2 * 9/2006 ..... E04G 23/0218
FR 3018298 A1 * 9/2015 ..... E04C 5/08
JP 2001262842 A * 9/2001
KR 2020042665 A * 4/2020 ..... E04G 23/0218
RU 2633622 C1 * 10/2017 ..... E04G 23/0244
WO WO-8803593 A * 5/1988 ..... E04G 23/0218
WO WO-2005026450 A1 * 3/2005 ..... E02D 5/64
WO WO-2006116860 A1 * 11/2006 ..... E04H 12/20

* cited by examiner

DEVICE AND METHOD FOR REINFORCING ROUND SECTION WOOD BEAM BY COMBINATION OF PRESTRESSED FRP SHEET AND HIGH STRENGTH STEEL WIRE ROPE

CROSS REFERENCE TO RELATED APPLICATION(S)

This patent application claims the benefit and priority of Chinese Patent Application No. 202011415724.4, filed on Dec. 7, 2020, the disclosure of which is incorporated by reference herein in its entirety as part of the present application.

TECHNICAL FIELD

The present disclosure relates to a device and a method for reinforcing a round section wood beam by the combination of a prestressed Fiber Reinforced Plastic (FRP) sheet and a high strength steel wire rope.

BACKGROUND ART

In order to respond to the general requirements of industrial prosperity, ecological livability, rural civilization, effective governance, and rich life put forward by the Rural Revitalization Strategy, promote rural economic development, and build a beautiful countryside, we have to carry out necessary maintenance and reinforcement on traditional residential buildings.

For the traditional residential buildings, a main structural system is a wood frame load-bearing structural system, and a load-bearing material used by the same is mainly based on a wood material. The wood material is a naturally degradable green organic material (which is also an advantage of it as a healthy and environment-friendly natural material), it is easily eroded by microorganisms, such as wood rot fungi, and termites, so as to cause the external and internal decay of the wood material, thereby resulting in the loss of architectural value information and the damage of style. For the seriously decayed members, structural comfort and safety problems, such as uncomfortable excessive deformation and sudden brittle fracture, will even occur due to excessive performance degradation.

At present, the existing wood beam reinforcement methods include: bolt reinforcement, wood plate clamping, steel plate supporting, built-in core material, supporting, FRP reinforcement, prestressed reinforcement, etc. In addition, it is often necessary to use auxiliary reinforcement methods, such as polymer material grouting, local embedding or cladding, to continue reinforcing. However, these methods have certain limitations, which can only perform temporary repair and reinforcement. In addition, later maintenance is quite troublesome. Even for some flexural members with great deformation, many traditional reinforcement methods are often limited or the repair effect is poor. Most of the traditional reinforcement methods perform repair by craftsman experience, but there is no complete and systematic reinforcement scientific method. For relatively novel FRP reinforcement, it is a passive reinforcement method, which needs to deform to a certain extent to play a role, and often does not greatly improve the stiffness of the member. Although the utilization rate and the stiffness of material properties can be improved by applying prestress, the process is often complex, and particularly, it is more difficult for members with similar round sections.

SUMMARY

An objective of the present disclosure is to provide a device and method for reinforcing a round section wood beam by the combination of a prestressed FRP sheet and a high strength steel wire rope. The device and the method solve the problems of the deficiency of stiffness and bearing capacity for flexural members in practical engineering, like wood beams.

A technical solution of the present disclosure is that: a device for reinforcing a round section wood beam by the combination of a prestressed FRP sheet and a high strength steel wire rope includes an FRP sheet adhered to a bottom surface of a log beam in the length direction. A middle supporting piece is mounted in the middle of the log beam. An end part reinforcing anchoring piece is mounted at each of two ends of the log beam. A plurality of layers of FRP hoops are adhered to the log beam and are located between the middle supporting piece and each of the end part reinforcing anchoring pieces at intervals in the length direction. High strength steel wire ropes with both ends connected to the corresponding end part reinforcing anchoring piece are respectively arranged on the two sides of the middle supporting piece.

Further, the middle supporting piece includes a bottom arc-shaped steel plate arranged on the log beam upside down. A top arc-shaped steep plate with two ends respectively connected to the bottom arc-shaped steel plate is arranged on the bottom arc-shaped steel plate upside down. A pair of pressure-bearing hole anchors, which are used for the high strength steel wire rope to penetrate through in turn and are arranged at an interval, are respectively arranged on two sides of the bottom arc-shaped steel plate.

Further, two ends of the top arc-shaped steel plate are respectively arranged on the outer sides of the two ends of the bottom arc-shaped steel plate; and the two side parts of the bottom arc-shaped steel plate are respectively provided with connecting bolts that penetrate through the top arc-shaped steel plate and are locked through nuts.

Further, the end part reinforcing anchoring piece includes a top arc-shaped steel strip. Two side ends of the top arc-shaped steel strip are respectively connected to side arc-shaped steel plates, and the other ends of the side arc-shaped steel plates are respectively connected to bottom rectangular flange plates. The two bottom rectangular flange plates are connected by capped bolts arranged at intervals in the length direction.

Further, the side parts of the side arc-shaped steel plates are respectively provided with perforated anchoring pieces connected to the high strength steel wire ropes, and the two perforated anchoring pieces located on the same side and the pressure-bearing hole anchors are not in the same line.

Further, the two ends of the top arc-shaped steel strip are respectively arranged on the outer side of the side arc-shaped steel plates upside down. The connecting bolts that penetrate through the top arc-shaped steel plate are arranged on the side arc-shaped steel plates and are locked through nuts.

Further, the other ends of the side arc-shaped steel plates are welded with the bottom rectangular flange plates; and three to four circular holes used for realizing connection through the connection of the capped bolts are formed in the bottom rectangular flange plates.

Further, a pressure-bearing anchor is arranged at one end of the high strength steel wire rope. The pressure-bearing anchor is anchored and connected to an end part reinforcing anchoring piece used as an anchoring end. A perforated screw is arranged at the other end of the high strength steel wire rope. The perforated screw is connected to the end part reinforcing anchoring piece used as a tensioning end and applies pre-tightening force through a screw cap.

A method for reinforcing a round section wood beam by the combination of a prestressed FRP sheet and a high strength steel wire rope involves the device for reinforcing the round section wood beam by the combination of the prestressed FRP sheet and the high strength steel wire rope includes the following steps:

S1, unloading an upper load of a damaged log beam, and then performing supporting;

S2, treating the surface of the log beam, embedding or wrapping the damaged part, implementing an embedded part by using a 3D printing technology, adhering the FRP sheet to a pressed side, and performing next step after the FRP sheet is adhered firmly;

S3, mounting end part reinforcing anchoring pieces at two ends of the log beam, if there is slight damage at an end part, then filling a gap between the end part and the end part reinforcing anchoring piece with a structural adhesive to enhance the strength thereof and prevent sliding, and then mounting a lengthened middle supporting piece;

S4, enabling a high strength steel wire rope to penetrate through the perforated anchoring piece of the end part reinforcing anchoring piece at an anchoring end, a pressure-bearing hole anchor on a middle supporting piece side, and a hole in a perforated long screw, and anchoring the two ends of the steel wire rope; and enabling the perforated long screw to penetrate through the perforated anchoring piece of the end part reinforcing anchoring piece at a tensioning end and applying a force to the steel wire rope by screwing a nut, during the process, the force being controlled by using a torque wrench, and real-time monitoring being performed on the deflection of the beam by using a displacement meter; and S5, adhering an FRP sheet to a tensioned side of the log beam after the log beam produces a slight reverse arch, adhering and compressing by using FRP hoops, and recovering the upper load after FRP hoops are adhered tightly, where if the beam is still in a reserve arch state at this time, then the high strength steel wire rope may be released properly, so that the bottom of the beam produces tension strain to complete the application of the prestressed force to the FRP sheet.

Compared with the prior art, the device and the method have the following beneficial effects:

(1) The device and the method not only facilitate reinforcement construction and have little disturbance to the original structure, but also can achieve the effects of improving the bearing capacity, the stiffness, and the ductility, and controlling the deformation. The reliability and safety level of the structure can also be improved indirectly through the arrangement of two lines of defense. The problems of deficiency of stiffness and bearing capacity are solved for flexural members in actual engineering, like wood beams. The device and the method are not only suitable for the enhancement and reinforcement of a newly built structural member, but also suitable for the repair and reinforcement of existing structures. However, the reinforcement device is based on a series of common members, such as wood beams with approximate round sections, in traditional residential buildings. Therefore, the device is not applicable to a wood beam with a rectangular section and a wood beam with serious end damage, but it can be used for performing improvement and optimization on this basis to make it applicable, and its reinforcement method is also similar.

(2) The device and the method control the damage and deformation of the wood beam by using the device for reinforcing the round section wood beam by the combination of the prestressed FRP sheet and the high strength steel wire rope, achieve the purpose of improving the bearing capacity, the stiffness, the ductility, and the safety reserve of the wood beam, and have a good reinforcement effect.

(3) The reinforcement method belongs to in-situ reinforcement, which does not need to dismantle the wood beam and drop the frame for overhaul, has little interference with the lives of residents, and has little disturbance on the whole structure.

(4) Combined reinforcement of an FRP reinforcement material and the high strength steel wire rope can provide the structure with two lines of defense, which can prevent the brittle fracture of members and improve the ductility of the members. When one of the reinforcement materials approaches a limit state, the other reinforcement material can continue to provide bearing capacity, so the safety reserve is sufficient.

(5) The prestressed reinforcement method adopted by the present disclosure can change passive reinforcement into active reinforcement, which gives full play to the mechanical properties of the reinforcement materials to a great extent.

(6) The FRP sheet and the steel wire rope have the characteristics of light weight, high strength, wear resistance, corrosion resistance, high temperature resistance, fatigue resistance, etc., so that the aging resistance, the corrosion resistance, and the moisture resistance of the wood beams can be improved, the initial defects of the wood beams can be improved, as well as series of problems, such as corrosion and weight increase, caused by traditional iron piece reinforcement methods are solved.

Figure 1:
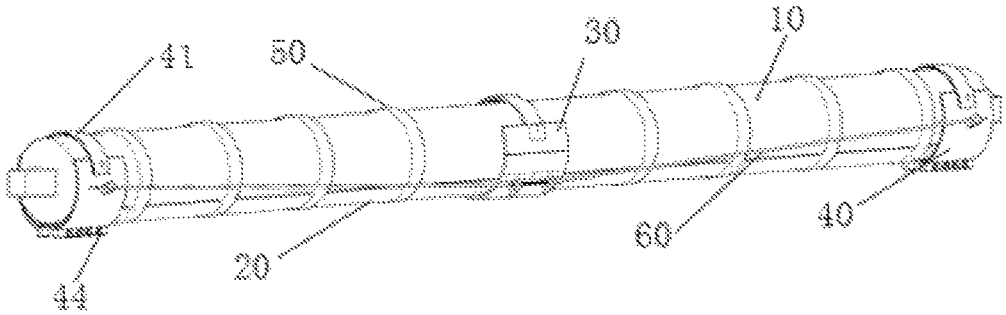
FIG. 1 is a schematic diagram of a device for reinforcing a round section wood beam by the combination of a prestressed FRP sheet and a high strength steel wire rope in an embodiment of the present disclosure.

Reference signs in the drawings: 10—log beam; 20—FRP sheet; 30—middle supporting piece; 31—bottom arc-shaped steel plate; 32—top arc-shaped steel plate; 33—pressure-bearing hole anchor; 34—connecting bolt; 35—nut; 40—end part reinforcing anchoring piece; 41—top arc-shaped steel strip; 42—side arc-shaped steel plate; 43—bottom rectangular flange plate; 44—capped bolt; 45—perforated anchoring piece; 46—connecting bolt; 50—FRP hoop; 60—high strength steel wire rope; 61—pressure-bearing anchor; 62—perforated screw; and 63—screw nut.

DETAILED DESCRIPTION OF THE EMBODIMENTS

In order to make the above-mentioned characteristics and advantages of the present disclosure more obvious and understandable, detailed description is made as below by giving embodiments with reference to the attached drawings hereafter. However, the present disclosure is not limited to this.

Figure 2:
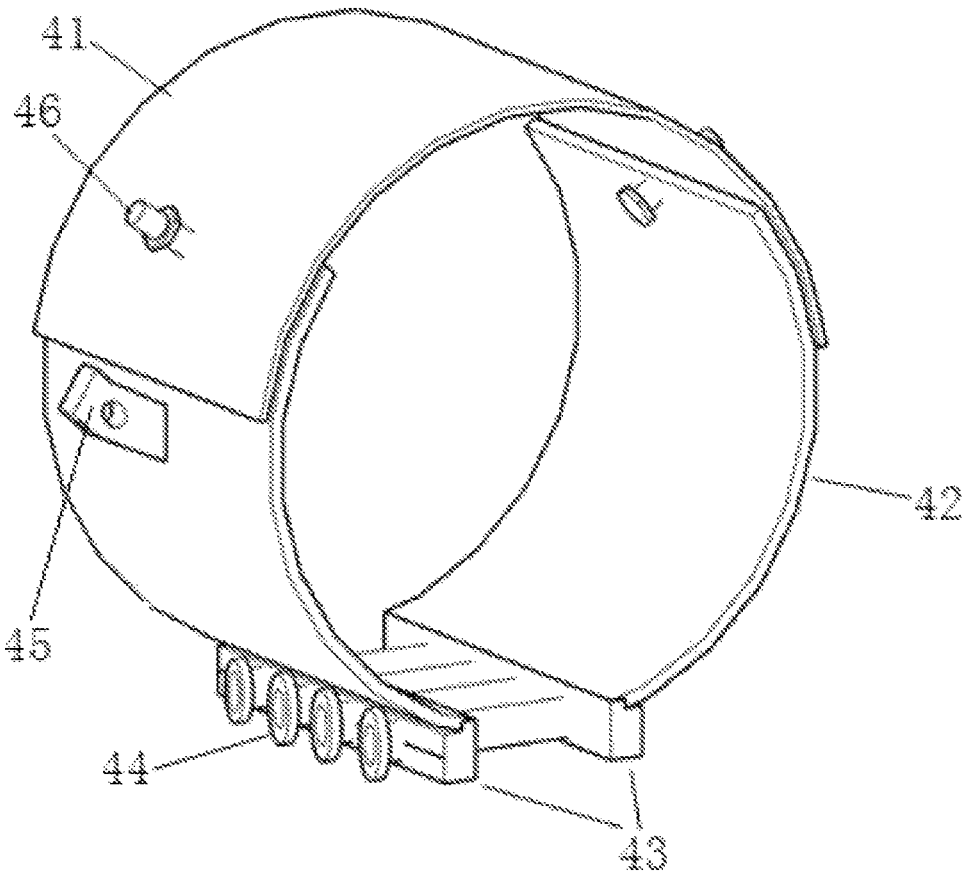
FIG. 2 is a schematic diagram of an end part reinforcing anchoring piece in an embodiment of the present disclosure.
Figure 3:
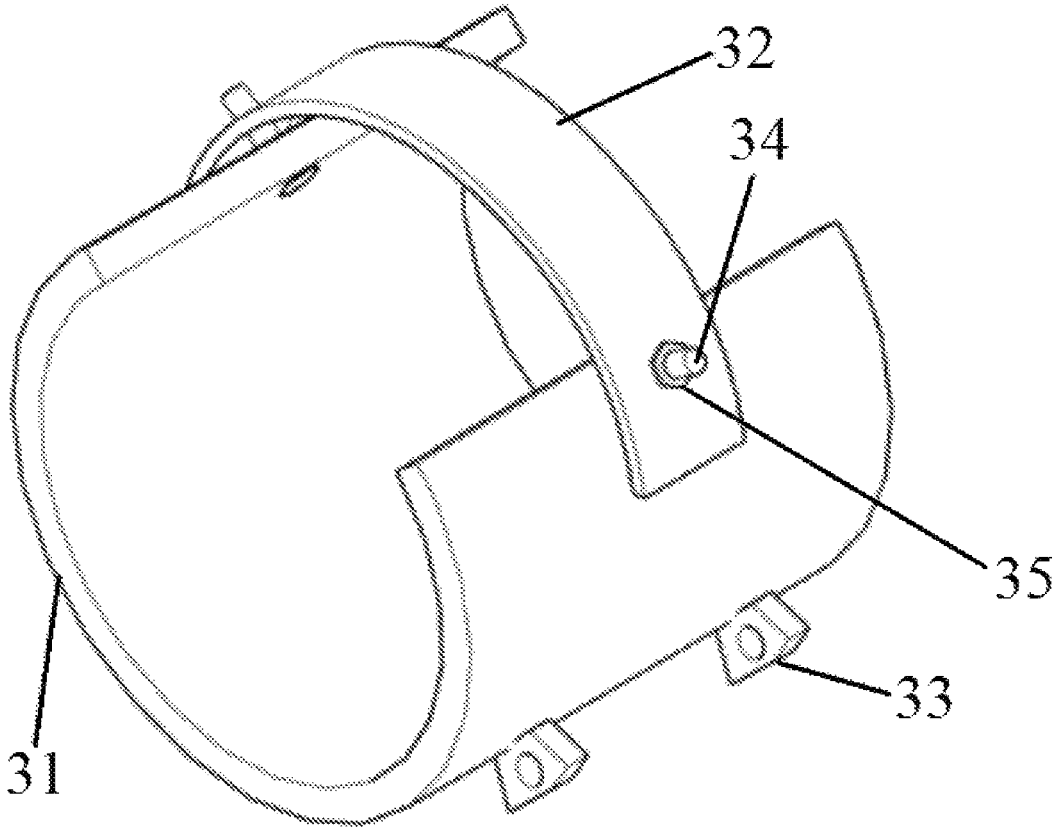
FIG. 3 is a schematic diagram of a middle supporting piece in an embodiment of the present disclosure.
Figure 4:
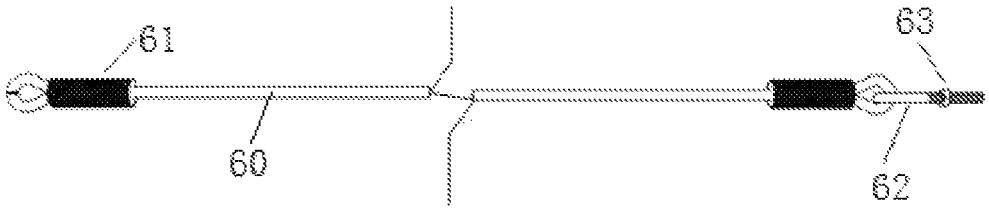
FIG. 4 is a schematic diagram of the high strength steel wire rope in an embodiment of the present disclosure.

Referring to FIG. 1 to FIG. 4

A device for reinforcing a round section wood beam by the combination of a prestressed Fiber Reinforce Plastic (FRP) sheet and a high strength steel wire rope includes FRP sheet 20 adhered to a bottom surface of a log beam 10 in the length direction. A middle supporting piece 30 is mounted in the middle of the log beam. An end part reinforcing anchoring piece 40 is mounted at each of two ends of the log beam. A plurality of layers of FRP hoops 50 are adhered to the log beam and are located between the middle supporting piece and each of the end part reinforcing anchoring pieces at intervals in the length direction. High strength steel wire ropes 60 with both ends connected to the corresponding end part reinforcing anchoring pieces are respectively arranged on the two sides of the middle supporting piece.

In the present embodiment, the middle supporting piece includes a bottom arc-shaped steel plate 31 arranged on the log beam upside down. A top arc-shaped steep plate 32 of which the two ends are respectively connected to the bottom arc-shaped steel plate is arranged on the bottom arc-shaped steel plate upside down. A pair of pressure-bearing hole anchors 33, which are used for the high strength steel wire rope to penetrate through in turn and are arranged at an interval, are respectively arranged on two sides of the bottom arc-shaped steel plate.

In the present embodiment, two ends of the top arc-shaped steel plate are respectively arranged on the outer sides of the two ends of the bottom arc-shaped steel plate. The two side parts of the bottom arc-shaped steel plate are respectively provided with connecting bolts 34 that penetrate through the top arc-shaped steel plate and are locked through nuts 35.

In the present embodiment, the end part reinforcing anchoring piece includes a top arc-shaped steel strip 41. Two side ends of the top arc-shaped steel strip are respectively connected to side arc-shaped steel plates 42. The other ends of the side arc-shaped steel plates are respectively connected to bottom rectangular flange plates 43. The two bottom rectangular flange plates are connected by capped bolts 44 arranged at intervals in the length direction.

In the present embodiment, the side parts of the side arc-shaped steel plates are respectively provided with perforated anchoring pieces 45 connected to the high strength steel wire ropes, and the two perforated anchoring pieces located on the same side and the pressure-bearing hole anchors are not in the same line, so that the bottom arc-shaped steel plate can apply a pressure to the log beam better when a pre-tightening force is applied to the high strength steel wire ropes.

In the present embodiment, two ends of the top arc-shaped steel plate are respectively arranged on the outer sides of the two ends of the bottom arc-shaped steel plate; and the two side parts of the bottom arc-shaped steel plate are respectively provided with connecting bolts 46 that penetrate through the top arc-shaped steel plate and are locked through nuts.

In the present embodiment, the other ends of the side arc-shaped steel plates are welded with the bottom rectangular flange plates. Three to four circular holes used for realizing connection through the connection of the capped bolts are formed in the bottom rectangular flange plates.

In the present embodiment, a pressure-bearing anchor 61 is arranged at one end of the high strength steel wire rope. The pressure-bearing anchor is anchored and connected to the end part reinforcing anchoring piece used as an anchoring end. A perforated screw 62 is arranged at the other end of the high strength steel wire rope. The perforated screw is connected to the end part reinforcing anchoring piece used as a tensioning end and applies pre-tightening force through a screw cap 63. A pressure-bearing section of the high strength steel wire rope is subjected to certain reinforcement and wear-resistant treatment.

A method for reinforcing the round section wood beam by the combination of the prestressed FRP sheet and the high strength steel wire rope involves the device for reinforcing the round section wood beam by the combination of the prestressed FRP sheet and the high strength steel wire rope and includes the following steps:

S1: An upper load of a damaged log beam is unloaded, the surface of the log beam is treated, a decayed part of the log beam is removed, and then the log beam is wrapped or embedded with a wood block or other suitable materials, and is wrapped with an FRP sheet. A modern scanning technology and a 3D printing technology can be combined for the wood block that needs to be embedded. First, an excavated part is scanned to obtain a model thereof, and then the model is printed by a 3D printing method. A printing material needs to be similar to the properties of wood. Through such a method, a series of problems encountered in carving embedded wood blocks can be avoided. A crack with large width is embedded with the wood block, and a crack with large length is repaired with polymer material grouting.

S2: After the surface damage is treated, supporting is performed symmetrically at the positions of ⅓ of the beam length (if a supporting position is damaged seriously, the position should be adjusted properly) to recover the deformation. Then, the FRP sheet is adhered in the middle of span, and hoops are hooped and reinforced at two ends of the FRP sheet subsequently. In addition, surface cleaning surface is performed for other parts, so that the FRP sheet can be firmly adhered to the wood material. If there is damage on a pressed side, the next step should be performed after the FRP sheet is adhered to the pressed side in advance before supporting or applying prestress.

S3: A middle supporting piece is mounted in the middle of the span of the log beam, and an end part reinforcing anchoring piece at a tensioning end and an end part reinforcing anchoring piece at an anchoring end are mounted at two ends of the log beam. If there is slight damage at an end part, a gap between the end part and the end part reinforcing anchoring piece is filled with a structural adhesive to enhance the strength thereof and prevent sliding, where the mounting of the end part reinforcing anchoring piece includes the following steps in turn: (a) bypassing the top arc-shaped steel strip around the log beam; (b) reversely buckling, connecting and fixing the side arc-shaped steel plates welded with flange plates and the top arc-shaped steel strip; and (c) connecting and fixing the bottom flange plate by using a bolt or a long screw and two pairs of nuts; similarly, reversely buckling, connecting and fixing the bottom arc-shaped steel plate and the top steel strip by the middle supporting piece through bolts; and then, mounting the lengthened middle supporting piece.

S4: The high strength steel wire rope is enabled to penetrate through a perforated anchoring piece of the end part reinforcing anchoring piece at an anchoring end, a pressure-bearing hole anchor on the middle supporting piece, and an anchoring hole in the end part reinforcing anchoring piece at a tensioning end in turn. The steel wire rope at the anchoring end is fixed after penetrating through a pressure-bearing anchor. At the tensioning end, after the steel wire rope penetrates through the perforated long screw and is anchored, the nut is screwed to apply the prestress to the steel wire rope through a torque wrench. However, it is noted that the prestress is applied to the two sides of the tensioning end simultaneously and synchronously to ensure that the beam does not cause lateral buckling, when the prestress is applied, the force is controlled by using the torque wrench, and the deflection of the beam is monitored by a displacement meter in real time, so that the reading values of the torque wrench is ensured within a certain range.

S5: Prestress is applied to the steel wire rope until the beam produces a certain reverse arch (a reverse arch value needs to be monitored and controlled by arranging displacement meters at key positions, such as the middle of the span), corresponding supporting pieces are removed after the log beam produces slight reverse arch. The FRP sheet is adhered to the tensioned side of the log beam, and FRP hoops are adhered and pressed tightly, so as to prevent the edge of the FRP sheet from wrapping and the like in subsequent stress.

S6: After the bonding strength between the FRP sheet and the wood beam reaches a certain value or the number of curing days reaches a specified number of days, the steel wire rope is released properly, so that the deflection of the beam recovers a normal deformation value to complete the application of the prestress. If an upper part has an external load, and the load is only unloaded during construction, then the application of the prestress to the FRP sheet is realized by recovering the load, and if the beam is still in a reverse arch state, the high strength steel wire rope may be released properly.

Another method for reinforcing the round section wood beam by the combination of the prestressed FRP sheet and the high strength steel wire rope involves the device for reinforcing the round section wood beam by the combination of the prestressed FRP sheet and the high strength steel wire rope and includes the following steps:

S1: An upper load of a damaged log beam is unloaded, and the surface of the log beam is treated, a decayed part of the log beam is removed, and then the log beam is wrapped or embedded with a wood block or other suitable materials, and is wrapped with FRP sheet. A modern scanning technology and a 3D printing technology can be combined for the wood block that needs to be embedded. First, an excavated part is scanned to obtain a model thereof, and then the model is printed by a 3D printing method. A printing material needs to be similar to the properties of wood. Through such a method, a series of problems encountered in carving embedded wood blocks can be avoided. A crack with large width is embedded with the wood block, and a crack with large length is repaired with polymer material grouting.

S2: After the surface damage is treated, supporting is performed symmetrically at the position of ⅓ of the beam length (if the supporting position is damaged seriously, the position should be adjusted properly) to recover the deformation. Then, the FRP sheet is adhered in the middle of span, and hoops are hooped and reinforced at two ends of the FRP sheet subsequently. In addition, surface cleaning surface is performed for other parts, so that the FRP sheet can be firmly adhered to a wood material. If there is damage on a pressed side, the next step should be performed after the FRP sheet is adhered to the pressed side in advance before supporting or applying prestress.

S3: A middle supporting piece is mounted in the middle of the span of the log beam, and an end part reinforcing anchoring piece at a tensioning end and an end part reinforcing anchoring piece at an anchoring end are mounted at two ends of the log beam. If there is slight damage at an end part, a gap between the end part and the end part reinforcing anchoring piece with a structural adhesive to enhance the strength thereof and prevent sliding, where the mounting of the end part reinforcing anchoring piece includes the following steps in turn: (a) bypassing the top arc-shaped steel strip around the log beam; (b) reversely buckling, connecting and fixing the side arc-shaped steel plates welded with flange plates and the top arc-shaped steel strip; and (c) connecting and fixing the bottom flange plate by using a bolt or a long screw and two pairs of nuts; similarly, reversely buckling, connecting and fixing the bottom arc-shaped steel plate and the top steel strip by the middle supporting piece through bolts; and then, mounting the lengthened middle supporting piece, where two middle supporting pieces need to be mounted at ⅓ positions of the beam respectively, and should be far away from the end parts.

S4: The high strength steel wire rope is enabled to penetrate through a perforated anchoring piece of the end part reinforcing anchoring piece at an anchoring end, pressure-bearing hole anchors on the two middle supporting pieces at the ⅓ positions, and an anchoring hole in the end part reinforcing anchoring piece at a tensioning end in turn. The steel wire rope at the anchoring end is fixed after penetrating through a pressure-bearing anchor. At the tensioning end, after the steel wire rope penetrates through the perforated long screw and is anchored, the nut is screwed to apply the prestress to the steel wire rope through a torque wrench. However, it is noted that the prestress is applied to the two sides of the tensioning end simultaneously and synchronously to ensure that the beam does not cause lateral buckling, when the prestress is applied, the force is controlled by using the torque wrench, and the deflection of the beam is monitored by a displacement meter in real time, so that the reading values of the torque wrench is ensured within a certain range.

S5: Prestress is applied to the steel wire rope until the beam produces a certain reverse arch (a reverse arch value needs to be monitored and controlled by arranging displacement meters at key positions, such as the middle of the span), corresponding supporting piece is removed after the log beam produces slight reverse arch. The FRP sheet is adhered to the tensioned side of the log beam, and FRP hoops are adhered and pressed tightly, so as to prevent the edge of the FRP sheet from wrapping and the like in subsequent stress.

S6: After the bonding strength between the FRP sheet and the wood beam reaches a certain value or the number of curing days reaches a specified number of days, the steel wire rope is released properly, so that the deflection of the beam recovers a normal deformation value to complete the application of the prestress. If an upper part has an external load, and the load is only unloaded during construction, then the application of the prestress to the FRP sheet is realized by recovering the load, and if the beam is still in a reverse arch state, the high strength steel wire rope may be released properly.

The above description is only a preferred embodiment of the present disclosure. For those of ordinary skill in the art, different forms of devices and methods for reinforcing a round section wood beam by the combination of a prestressed FRP sheet and a high strength steel wire rope are designed without creative efforts according to the teaching of the present disclosure. All equivalent changes, modifications, substitutions, and variations made in accordance with the scope of the patent application of the present disclosure without departing from the principle and spirit of the present disclosure shall fall within the scope of the present disclosure.

What is claimed is:

1. A device for reinforcing a round section wood beam by the combination of a prestressed Fiber Reinforce Plastic (FRP) sheet and a steel wire rope, comprising FRP sheet adhered to a bottom surface of a log beam in the length direction, wherein a middle supporting piece is mounted in the middle of the log beam; an end part reinforcing anchoring piece is mounted at each of two ends of the log beam; a plurality of layers of FRP hoops are adhered to the log beam and are located between the middle supporting piece and each of the end part reinforcing anchoring pieces at intervals in the length direction; and steel wire ropes with both ends connected to the corresponding end part reinforcing anchoring pieces are respectively arranged on the two sides of the middle supporting piece.

2. The device for reinforcing the round section wood beam by the combination of the prestressed FRP sheet and the steel wire rope according to claim 1, wherein the middle supporting piece comprises a bottom arc-shaped steel plate arranged on the log beam; a top arc-shaped steep plate of which the two ends are respectively connected to the bottom arc-shaped steel plate is arranged on the bottom arc-shaped steel plate; and a pair of pressure bearing hole anchors, which are used for the steel wire rope to penetrate through in turn and are arranged at an interval, are respectively arranged on two sides of the bottom arc-shaped steel plate.

3. The device for reinforcing the round section wood beam by the combination of the prestressed FRP sheet and the steel wire rope according to claim 2, wherein two ends of the top arc-shaped steel plate are respectively arranged on outer sides of the two ends of the bottom arc-shaped steel plate; and two side parts of the bottom arc-shaped steel plate are respectively provided with connecting bolts that penetrate through the top arc-shaped steel plate and are locked through nuts.

4. The device for reinforcing the round section wood beam by the combination of the prestressed FRP sheet and the steel wire rope according to claim 3, wherein the end part reinforcing anchoring piece comprises a top arc-shaped steel strip; two side ends of the top arc-shaped steel strip are respectively connected to side arc-shaped steel plates; the other ends of the side arc-shaped steel plates are respectively connected to bottom rectangular flange plates; and the two bottom rectangular flange plates are connected by capped bolts arranged at intervals in the length direction.

5. The device for reinforcing the round section wood beam by the combination of the prestressed FRP sheet and the steel wire rope according to claim 4, wherein side parts of the side arc-shaped steel plates are respectively provided with perforated anchoring pieces connected to the steel wire ropes, and the two perforated anchoring pieces located on the same side and the pressure-bearing hole anchors are not in the same line.

6. The device for reinforcing the round section wood beam by the combination of the prestressed FRP sheet and the steel wire rope according to claim 5, wherein a pressure-bearing anchor is arranged at one end of the steel wire rope; the pressure-bearing anchor is anchored and connected to the end part reinforcing anchoring piece used as an anchoring end; a perforated screw is arranged at the other end of the steel wire rope; and the perforated screw is connected to the end part reinforcing anchoring piece used as a tensioning end and applies pre-tightening force through a screw cap.

7. The device for reinforcing the round section wood beam by the combination of the prestressed FRP sheet and the steel wire rope according to claim 4, wherein two ends of the top arc-shaped steel strip are respectively arranged on outer side of the side arc-shaped steel plates; and the connecting bolts that penetrate through the top arc-shaped steel plate are arranged on the side arc-shaped steel plates and are locked through nuts.

8. The device for reinforcing the round section wood beam by the combination of the prestressed FRP sheet and the steel wire rope according to claim 4, wherein the other ends of the side arc-shaped steel plates are welded with the bottom rectangular flange plates; and three to four circular holes used for realizing connection through the connection of the capped bolts are formed in the bottom rectangular flange plates.

9. The device for reinforcing the round section wood beam by the combination of the prestressed FRP sheet and the steel wire rope according to claim 2, wherein the end part reinforcing anchoring piece comprises a top arc-shaped steel strip; two side ends of the top arc-shaped steel strip are respectively connected to side arc-shaped steel plates; the other ends of the side arc-shaped steel plates are respectively connected to bottom rectangular flange plates; and the two bottom rectangular flange plates are connected by capped bolts arranged at intervals in the length direction.

10. The device for reinforcing the round section wood beam by the combination of the prestressed FRP sheet and the steel wire rope according to claim 9, wherein side parts of the side arc-shaped steel plates are respectively provided with perforated anchoring pieces connected to the steel wire ropes, and the two perforated anchoring pieces located on the same side and the pressure-bearing hole anchors are not in the same line.

11. The device for reinforcing the round section wood beam by the combination of the prestressed FRP sheet and the steel wire rope according to claim 10, wherein a pressure-bearing anchor is arranged at one end of the steel wire rope; the pressure-bearing anchor is anchored and connected to the end part reinforcing anchoring piece used as an anchoring end; a perforated screw is arranged at the other end of the steel wire rope; and the perforated screw is connected to the end part reinforcing anchoring piece used as a tensioning end and applies pre-tightening force through a screw cap.

12. The device for reinforcing the round section wood beam by the combination of the prestressed FRP sheet and the steel wire rope according to claim 9, wherein two ends of the top arc-shaped steel strip are respectively arranged on outer side of the side arc-shaped steel plates; and connecting bolts that penetrate through the top arc-shaped steel plate are arranged on the side arc-shaped steel plates and are locked through nuts.

13. The device for reinforcing the round section wood beam by the combination of the prestressed FRP sheet and the steel wire rope according to claim 9, wherein the other ends of the side arc-shaped steel plates are welded with the bottom rectangular flange plates; and three to four circular holes used for realizing connection through the connection of the capped bolts are formed in the bottom rectangular flange plates.

14. A method for reinforcing the round section wood beam by the combination of the prestressed FRP sheet and the steel wire rope, involving the device for reinforcing the round section wood beam by combining the prestressed FRP sheet and the steel wire rope according to claim 11, and comprising the following steps:

S1, unloading an upper load of a damaged log beam, and then performing supporting;

S2, treating the surface of the log beam, embedding or wrapping the damaged part, implementing an embedded part by using a 3D printing technology, adhering an FRP sheet to a pressed side, and performing next step after the FRP sheet is adhered firmly;

S3, mounting end part reinforcing anchoring pieces at two ends of the log beam, if there is slight damage at an end part, then filling a gap between the end part and the end part reinforcing anchoring piece with a structural adhesive to enhance the strength thereof and prevent sliding, and then mounting a lengthened middle supporting piece;

S4, enabling a steel wire rope to penetrate through the perforated anchoring piece of the end part reinforcing anchoring piece at an anchoring end, a pressure-bearing hole anchor on a middle supporting piece side, and a hole in a perforated long screw, and anchoring the two ends of the steel wire rope; and enabling the perforated long screw to penetrate through the perforated anchoring piece of the end part reinforcing anchoring piece at a tensioning end and applying a force to the steel wire rope by screwing a nut, during the process, the force being controlled by using a torque wrench, and real-time monitoring being performed on the deflection of the beam by using a displacement meter; and S5, adhering an FRP sheet to a tensioned side of the log beam after the log beam produces a slight reverse arch, adhering and compressing by using FRP hoops, and recovering the upper load after the FRP hoops are adhered tightly, wherein if the beam is still in a reserve arch state at this time, then the steel wire rope may be released properly, so that the bottom of the beam produces tension strain to complete the application of the prestressed force to the FRP sheet.

15. A method for reinforcing the round section wood beam by the combination of the prestressed FRP sheet and the steel wire rope, involving the device for reinforcing the round section wood beam by the combination of the prestressed FRP sheet and the steel wire rope according to claim 6, and comprising the following steps:

S1, unloading an upper load of a damaged log beam, and then performing supporting;

S2, treating the surface of the log beam, embedding or wrapping the damaged part, implementing an embedded part by using a 3D printing technology, adhering an FRP sheet to a pressed side, and performing next step after the FRP sheet is adhered firmly;

S3, mounting end part reinforcing anchoring pieces at two ends of the log beam, if there is slight damage at an end part, then filling a gap between the end part and the end part reinforcing anchoring piece with a structural adhesive to enhance the strength thereof and prevent sliding, and then mounting a lengthened middle supporting piece;

S4, enabling a steel wire rope to penetrate through the perforated anchoring piece of the end part reinforcing anchoring piece at an anchoring end, a pressure-bearing hole anchor on a middle supporting piece side, and a hole in a perforated long screw, and anchoring the two ends of the steel wire rope; and enabling the perforated long screw to penetrate through the perforated anchoring piece of the end part reinforcing anchoring piece at a tensioning end and applying a force to the steel wire rope by screwing a nut, during the process, the force being controlled by using a torque wrench, and real-time monitoring being performed on the deflection of the beam by using a displacement meter; and S5, adhering an FRP sheet to a tensioned side of the log beam after the log beam produces a slight reverse arch, adhering and compressing by using FRP hoops, and recovering the upper load after the FRP hoops are adhered tightly, wherein if the beam is still in a reserve arch state at this time, then the steel wire rope may be released properly, so that the bottom of the beam produces tension strain to complete the application of the prestressed force to the FRP sheet.

* * * * *